United States Patent [19]

Sahrbacker

[11] 3,977,751

[45] Aug. 31, 1976

[54] RELEASE MECHANISM FOR PLUG IN-TYPE TERMINALS

[75] Inventor: Edward V. Sahrbacker, Brecksville, Ohio

[73] Assignee: Lucerne Products, Inc., Hudson, Ohio

[22] Filed: Dec. 20, 1974

[21] Appl. No.: 534,668

[52] U.S. Cl. ..... 339/95 D; 339/258 R

[51] Int. Cl.[2] ..... H01R 9/08

[58] Field of Search..... 339/95 D, 248 S, 249 R, 339/252 R, 258 R

[56] References Cited

UNITED STATES PATENTS

| | | | |
|---|---|---|---|
| 2,738,482 | 3/1956 | Benander | 339/95 D X |
| 2,780,791 | 2/1957 | Morschel | 339/95 D X |
| 2,988,724 | 6/1961 | Larkin | 339/95 D |
| 3,138,421 | 6/1964 | Locher et al. | 339/95 D |
| 3,167,252 | 1/1965 | Smith | 339/95 D X |

*Primary Examiner*—Roy Lake
*Assistant Examiner*—E. F. Desmond
*Attorney, Agent, or Firm*—Baldwin, Egan, Walling & Fetzer

[57] ABSTRACT

A manually operable releasing mechanism for plug in-type terminals that are used for rapidly connecting electrical conducting lines to an electrical unit, and providing for rapid deactuation of the retainer for the conducting line to permit ready withdrawal of the conductor line from the unit, when so desired.

4 Claims, 6 Drawing Figures

RELEASE MECHANISM FOR PLUG IN-TYPE TERMINALS

This invention relates in general to plug in-type terminals, and more particularly to a means for quickly releasing a plug in-type terminal of the type having a spring element which grippingly engages the associated bared wire of the plug in conductor line.

BACKGROUND OF THE INVENTION

Plug in-type terminals are well known in the prior art and are used in various types of electrical apparatus for rapidly coupling the apparatus to electrical conductor lines. Once this plug in-type terminal is inserted into a unit, it is extremely difficult to remove the conductor wire. When it is desired to do so, it usually necessitates the insertion of a pointed instrument or the like, to attempt to effect release of the spring retainer blade from the conductor line. This aforesaid known operation of attempting to release the conductor line is time consuming and exasperating, and sometimes almost impossible. Compact electrical control switches for controlling an electric motor for use, for instance in portable electrical tools, appliances and the like, are a typical example of the environment wherein plug in-type terminals are conventionally utilized.

SUMMARY OF THE INVENTION

The present invention provides a novel releasing mechanism for use with plug in-type terminals, to permit rapid manual release of the conductor lines from the retainer element or elements when desired, yet which will not interfere with the operation of the retainer element in the deactuated condition of the releasing mechanism.

Accordingly an object of the invention is to provide a novel plug in-type terminal arrangement for use in various electrical apparatus.

Another object of the invention is to provide a mechanism of the latter type which is particularly adapted for use in conjunction with compact electrical control switches which are used for controlling an electric motor, as for instance, in portable electrical tools, appliances or the like.

A still further object of the invention is to provide a mechanism for the aforesaid type which can be used with existing compact switch structures, for controlling an electric motor, and as for instance, controlling the speed of an electric motor, and wherein the release mechanism is adapted to be quickly actuated to operative position merely by pressing on the release mechanism so as to cause release of the conventional spring retainer from coaction with a conductor wire.

A still further object of the invention is to provide a release mechanism for use with a compact electrical control switch for controlling the operation of electrical motor, used for instance in a portable electric tool, appliance or the like and wherein the release mechanism is adapted for complementary coaction with the existing structure of the control switch.

Another object of the invention is to provide a release mechanism of the above discussed type which is in the form of a U-shaped member of electrical insulating material, such as for instance plastic, with the upstanding arms of the U being adapted to be received within entry openings in a switch case of the control switch which receives bared conductor wires, at the plug in-type terminals thereof, and which release mechanism when pressed upwardly causes release of the conventional flexible spring blade retainers, to permit withdrawal of the conductor wires from the terminals, and with the blade retainers causing the aforesaid release mechanism to move to inactive position upon release thereof.

Other objects and advantages of the invention will be apparent from the following description taken in conjunction with the company drawings wherein:

DESCRIPTION OF PREFERRED EMBODIMENTS

Figure 1:
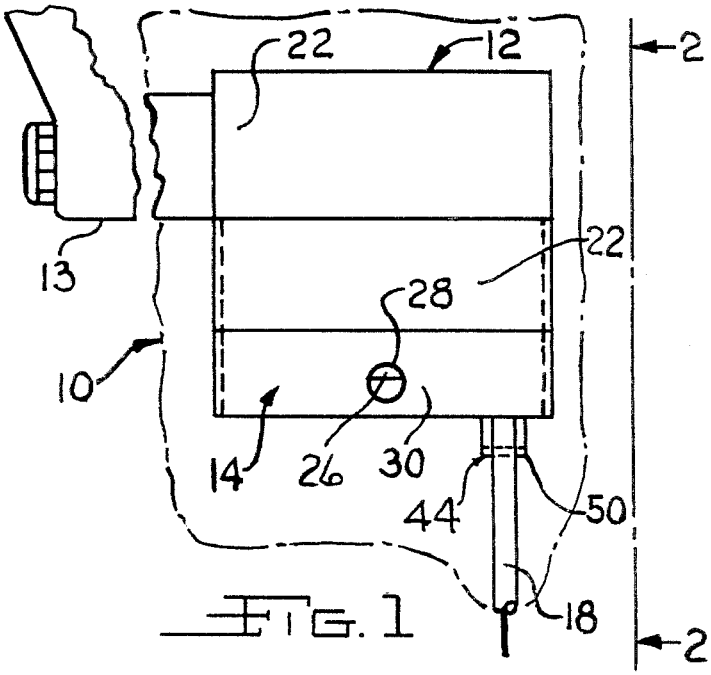
FIG. 1 is a fragmentary elevational view of an electrical apparatus and in particular a control switch for a portable power tool or the like, which embodies the present invention; in phantom lines there is shown a handle for the tool.

Referring now again to the drawings and in particular to FIG. 1 thereof, the latter illustrates with a reference number 10 and with phantom lines, a portion of a hand tool or utensil with which the present invention may be incorporated. The portion shown is that conventionally known as the pistol grip section of a portable type tool and which may include a trigger-switch assembly 12 mounted thereon adapted to control the operation of an electrical power unit, such as an electric motor (not shown) powering the tool. The trigger 13 of the trigger-switch assembly 12 may be of the reciprocal, spring loaded type which coacts with the switch mechanism in a known manner for actuation of the latter.

Electrical leads or conductor lines 18 and 20 may extend from the control module portion 14 of the control switch assembly, to form part of an electrical cord for coupling the tool to a suitable source of electrical power. Other electrical leads (not shown) generally also extend from the switch module 14 and form the connection to the electric motor that is controlled by the trigger-switch assembly 12. A spring coacting with the trigger 13 conventionally urges the trigger outwardly of the wrap around housing 22 of the trigger-switch assembly 12, and towards an "off" position.

The circuit components of the switch are housed primarily in and on a split two section casing 24 of module 14, the latter being received within the lower open bottom of the aforementioned switch housing 22 in a manner known in the art. Reference may be had to U.S. Pat. No. 3,536,973 issued Oct. 27, 1970 to P. H.

Matthews, et al for a disclosure of a split control module portion and wrap around housing for a trigger-switch assembly of the general type with which the present invention is shown as being utilized.

Means 24 are conventionally provided on the exterior of the split casing 24, for releasably holding the latter in the housing portion 22 of the trigger-switch assembly 12, and in a manner known in the prior art. In this connection, each module casing section may be provided with a projection 26 (FIG. 1) projecting laterally from the exterior side thereof, and which is adapted to be received in generally snap fastened relation in a complementary opening 28 in the confronting side of the housing 22, when the assembled module 14 is inserted into the underside of the housing 22, thus removably retaining the control module 14 therein. Housing 22 is conventionally formed of electrical insulating material such as, for instance plastic, with the lower sections of the side walls 30 thereof suitably resilient or yieldable for receiving the aforementioned laterally extending projections 26 on the module casing 14 in the aforementioned openings 28.

Figure 4:
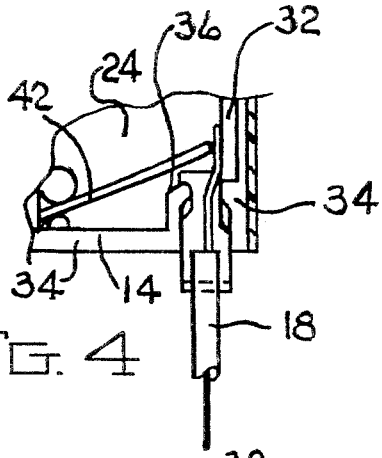
FIG. 4 is a fragmentary sectional view taken generally along the plane of line 4—4 of FIG. 2 looking in the direction of the arrows and showing the release mechanism in inactive position, and coacting with the conventional switch case of the control switch.
Figure 5:
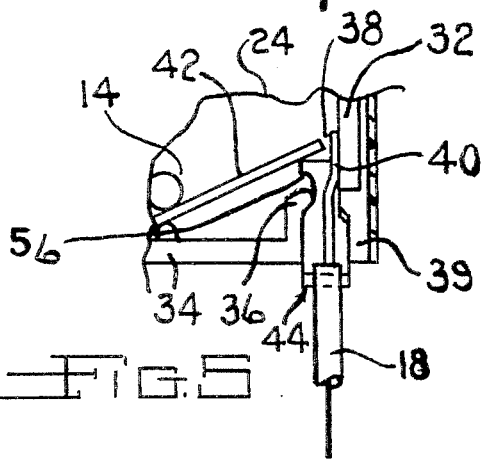
FIG. 5 is a sectional view taken generally along the plane of line 5—5 of FIG. 3 looking in the direction of the arrows and showing the release mechanism having been moved to active position, and having caused release of the spring retainer from the associated bared conductor wire for withdrawal of the latter from the plug in terminal.

Casing 24 of module 14 is also preferably formed of electrical insulating material, such as for instance, plastic or ceramic material, and has mounted thereon a group of stationary electrical conducting contacts, a portion of one of which (32) is illustrated in FIGS. 4 and 5.

The exterior of the casing 24 of module 14 is conventionally provided with a lip 34 integrally formed therewith and extending along the bottom extremity thereof, and which then extends upwardly to end in a rounded, nose-like portion 36 defining in part a passageway 38 between the nose-like portion 36 and a formed shoulder 39 on casing 24. Shoulder 39 is adapted to support the aforementioned stationary contact 32 as shown in FIGS. 4 and 5. Passageway 38 is adapted to receive the bared end of a conducting wire or line 18 or 20, as a plug in-type terminal, and to be held in electrical conducting relation with contact 32 by means of cantilevered spring retainer blade 42 mounted on the exterior of casing 24 in coacting relation with passageway 38 in a manner known in the prior art. Reference may be made to aforementioned U.S. Pat. No. 3,536,973 for a disclosure of a plug in-type terminal. The free end of the cantilevered blade 42 is adapted to grip the bared end of the associated conductor line (18 or 20) and lock it in abutted engagement with the confronting stationary contact 32. It will be seen that entry of the bared end of the conductor wire into the plug in-type terminal can be readily accomplished since the free end of the resilient retainer blade 42 is moved upwardly away from contact 32 upon entry of the bared wire from the bottom side of the trigger-switch assembly 12.

However, release of the wire conductor from the plug in terminal is rather difficult since it is tightly gripped by the resilient retainer blade 42 and pulling down on the conductor wire generally increases the grip of the retainer blade 42. Accordingly, in order to release the conductor wire from the plug in terminal generally requires the insertion of a sharpened instrument through the passage 38 so as to engage the underside of the spring retainer and move it upwardly against its resistance to flexure, away from gripping contact with the wire conductor at which time the latter can be removed by pulling down thereon. Insertion of such an instrument is awkward, difficult and time consuming.

Figure 2:
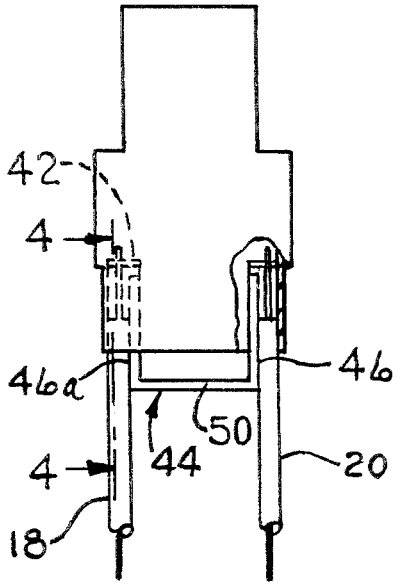
FIG. 2 is an end elevational view of the control switch of FIG. 1 taken generally along the plane of line 2—2 of FIG. 1 looking in the direction of the arrows.
Figure 3:
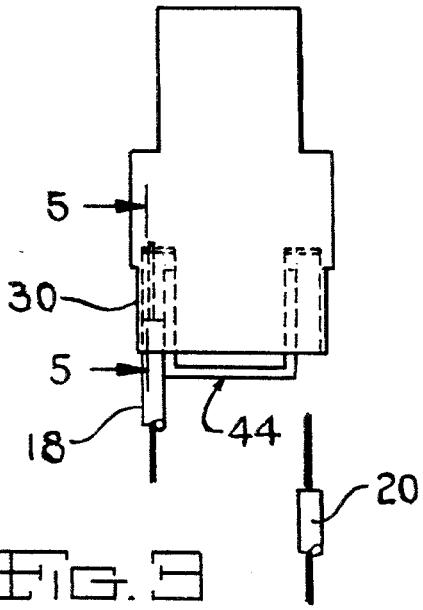
FIG. 3 is a view similar to FIG. 2, but illustrating one of the conductor wires having been removed by actuation of the release mechanism.
Figure 6:
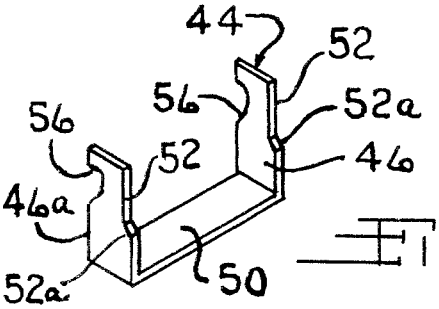
FIG. 6 is a perspective view of the release member illustrated in FIGS. 2 through 5.

In accordance with the invention, release mechanism 44 is provided, coacting with the trigger-switch assembly 12. In the embodiment illustrated mechanism 44 comprises a generally U-shaped member (FIG. 6) with the upstanding arms 46, **46*a* of the structure being received in the aforementioned associated passageway 38. As can be best seen in FIGS. 2 and 3, the cross portion 50 of the U-shaped structure extends below the trigger-switch assembly 12** where it is accessible (upon removal of course from the handle of the tool).

The rear side of each of the generally planar arms 46, **46*a* is preferably cut away as at 52 for coaction with the confronting shoulder 39. The oblique surface 52*a* formed by the cut away portion 52 is adapted for engagement with the underside of the shoulder 39 as can be best seen in FIG. 5, to positively limit the upward travel of the releasing member 44. As will be seen, upon pressing upwardly on the underside of member 44, the latter is moved upwardly from the inactive position shown as for instance in FIG. 4 wherein the blade 42 engages the bared end of the conductor line 18, to the active position shown in FIG. 5 wherein the arm 46*a* of the release member has engaged the retainer blade 42 and has raised it away from gripping coaction with the bared end of the wire conductor 18, thus releasing the latter from the plug in terminal, to permit ready withdrawal thereof. On release of the pressure on member 44, the resistance to deflection of the blade 42 causes the member 44** to be forced down or outwardly, and the end of the retainer blade pivots downwardly ready for grippingly engaging a conductor wire.

The forward edge of each of the arms 46, **46*a* is preferably provided with a recess 56 which coacts with the projection 36 of the switch case 24 for positively retaining the releasing member 44 on the trigger-switch assembly 12. In this connection it will be seen that the vertical height of the recess 56 is such as to provide sufficient clearance for the projection 36 so that the releasing member 44 can be moved up and down in the passageways 38 sufficiently to deactivate the spring retainer blade 42. Member 44 is made of electrical insulating material, such as for instance plastic, and is adapted to readily slide in the aforementioned passageways 38**.

From the foregoing description and the accompanying drawings, it will be seen that the invention provides a novel manually operable releasing mechanism for plug in-type terminals that can be used to rapidly deactuate the conventional retainer for the conducting line of the terminal, to permit ready withdrawal of the conductor line from the unit when so desired. The invention also provides a releasing mechanism that can be used with existing designs or constructions of trigger-switch assemblies, for expeditiously providing a means for deactivating the plug in-type terminals conventionally utilized with such assemblies.

The terms and expressions which have been used as terms of description and not of limitation, and there is no intention in the use of such terms and expressions of excluding any equivalents of any of the features shown or described, or portions thereof, and it is recognized that various modifications are possible within the scope of the invention claimed.

What is claimed is:

1. In an electrical switch mechanism for a portable type tool comprising a trigger-switch assembly, the latter including a module portion disposed within a switch housing, said switch module having spaced stationary electrical contacts thereon and including a spring like retainer coacting with each contact adapted when in active condition to engage an insertable conductor line for gripping the latter to hold it in place, said retainer including a generally diagonally arranges spring blade on said module which adjacent one end thereof is adapted to releasably engage the bared wire of the conductor line, for positioning the latter against the respective stationary electrical contact, said module generally adjacent each said stationary contact including a shoulder and a spaced lip portion defining a passageway for receiving the bared wire of the respective conductor line, the combination therewith of means mounted on said mechanism for selectively deactivating said blades to permit ready withdrawal of the conductor lines from coaction with the respective stationary contact, said deactivating means comprising a U-shaped pusher element having upstanding arms disposed in the associated of said passageways intermediate the respective shoulder and lip portion on the switch module, said element being slidable inwardly of said passageways so as to be engageable with the spring blades for moving the latter generally simultaneously out of gripping coaction with the respective bared wire to permit withdrawal of the conductor lines, the cross portion of said element disposed exteriorly of said switch housing exterior, means on the arms for coaction with the respective lip portion for retaining the pusher element in assembled relation with the switch mechanism, and including other means on the respective arm for limiting inward movement of said element with respect to said switch module, said arms being of sufficient length so that said cross portion of said pusher element is in spaced relation to said switch housing in all positions of said pusher element so as to be always oriented outwardly of said switch housing.

2. A mechanism in accordance with claim 1 wherein each of said arms is of generally planar configuration having on one side edge thereof an elongated recess comprising said retaining means and receiving therein said lip portion, and on the opposite side edge thereof comprising a cut away section defining an oblique surface comprising said limiting means which is adapted for coaction with said shoulder of said switch module to limit the inward movement of said pusher element with respect to said switch housing.

3. A switch mechanism in accordance with claim 2 including spaced conductor lines having bared ends extending into the respective passageway and into engagement with respective stationary contact, and removably held therein by the respective blade, said U-shaped element being disposed intermediate said conductor lines and being movable inwardly and outwardly relative thereto and relative to said switch housing.

4. A releasing mechanism for releasing a pair of spaced conductor lines from plug in-type terminals in an electrical switch mechanism for a portable type tool which includes a trigger-switch assembly comprising a switch housing and a removable electrical contact module disposed in the housing, said releasing mechanism being adapted to substantially simultaneously engage and deactivate a pair of spaced spring blade retainers on the module in said housing each of which retainers is adapted to grip a bared end of an associated conductor line inserted into the respective terminal, said releasing mechanism comprising a pusher element formed of semi-rigid plastic material and of generally U-shaped configuration in elevation, including upstanding planar arms and a connecting cross portion, each of said arms being engageable with the respective spring blade retainer on the electrical switch module so as to substantially simultaneously release the blade retainers from coaction with the respective conductor lines, one side edge of at least one of said arms having an elongated recess formed therein adapted for retaining coaction with a lip on the module for retaining the pusher element in assembled relation with the switch mechanism and the opposite side edge of at least one of said arms including a cut away portion defining an oblique surface thereon adapted for abutting engagement with a shoulder on said module for limiting the inward movement of the pusher element with respect to the module and associated switch housing, said arms being of sufficient length and said oblique surface being so disposed so that said cross portion of said pusher element is always disposed in spaced exterior relation to the switch housing of the electrical switch mechanism in all positions of said pusher element relative to the housing.

* * * * *